United States Patent [19]

Somorjai

[11] 4,390,345

[45] Jun. 28, 1983

[54] FUEL COMPOSITIONS AND ADDITIVE MIXTURES FOR REDUCING HYDROCARBON EMISSIONS

[76] Inventor: Gabor A. Somorjai, 665 San Luis Rd., Berkeley, Calif. 94707

[21] Appl. No.: 207,371

[22] Filed: Nov. 17, 1980

[51] Int. Cl.[3] ..... C10L 1/18

[52] U.S. Cl. ..... 44/63; 44/68

[58] Field of Search ..... 44/68, 63

[56] References Cited

U.S. PATENT DOCUMENTS

| | | | |
|---|---|---|---|
| 2,818,417 | 12/1953 | Brown et al. | 260/429 |
| 2,839,552 | 6/1953 | Shapiro et al. | 260/429 |
| 3,127,351 | 3/1964 | Brown et al. | 252/49.7 |
| 3,990,915 | 11/1976 | Newman et al. | 429/194 |
| 4,002,492 | 1/1977 | Rae | 429/194 |
| 4,049,879 | 9/1977 | Thompson et al. | 429/191 |
| 4,091,191 | 5/1978 | Gaines | 429/194 |
| 4,139,681 | 2/1979 | Klemann et al. | 429/191 |
| 4,143,213 | 3/1979 | Jacobson et al. | 429/112 |
| 4,166,888 | 9/1979 | Rao et al. | 429/194 |
| 4,191,536 | 3/1980 | Niebylski | 44/63 |

*Primary Examiner*—Charles F. Warren
*Assistant Examiner*—Y. Harris-Smith
*Attorney, Agent, or Firm*—Donald L. Johnson; Joseph D. Odenweller; John F. Hunt

[57] ABSTRACT

Gasoline compositions and additive mixtures containing compounds having the formula:

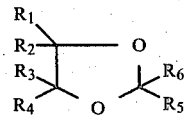

wherein $R_1$–$R_6$ are each independently selected from hydrogen or hydrocarbyl radicals in an amount sufficient to reduce exhaust hydrocarbon emissions from an internal combustion engine being operated on gasoline containing a cyclopentadienyl manganese antiknock. Preferred hydrocarbon exhaust emission reducing compounds are 1,3-dioxolane and the lower alkyl and alkenyl substituted derivatives thereof.

18 Claims, No Drawings

FUEL COMPOSITIONS AND ADDITIVE MIXTURES FOR REDUCING HYDROCARBON EMISSIONS

BACKGROUND OF THE INVENTION

Cyclopentadienyl manganese compounds have proven to be excellent antiknocks in gasolines used to operate internal combustion engines. They have been especially beneficial in solving some of the problems present when low-lead or lead-free gasolines are used with internal combustion engines. Use of such compounds as antiknocks is described in U.S. Pat. Nos. 2,818,417, 3,839,552 and 3,127,351, all incorporated herein by reference. It is believed, however by some researchers in the field, that under some operating conditions the presence of certain of these organomanganese antiknocks in some of today's low-lead or lead-free gasoline motor fuels tend, in some manner, not altogether fully understood, to promote or increase the amount of unburned and/or partially oxidized hydrocarbons emitted from an engine which is operated on such a fuel. Thus, a need exists for a method to reduce the amount of unburned or partially oxidized hydrocarbons introduced into the atmosphere from the exhaust gas of an internal combustion engine operating on a lead-free or substantially lead-free gasoline containing, as an antiknock, a cyclopentadienyl manganese antiknock gasoline. The present invention provides a simple effective means of alleviating this problem.

It has been previously suggested that the addition of a cyclic ether to gasoline mixes containing organomanganese antiknocks tends to reduce exhaust hydrocarbon emissions from an internal combustion engine being operated on such a gasoline mix. The addition of one such compound, tetrahydrofuran, to reduce exhaust hydrocarbon emissions is disclosed in recently issued U.S. Pat. No. 4,191,536. It is believed, however, that the particular cyclic ethers of the present invention have not heretofore been disclosed or rendered obvious for use as hydrocarbon emission reducing additives in gasoline containing organomanganese antiknocks. Dioxolane, the preferred exhaust emission reducing additive of the present invention, has previously found use as a solvent in electrochemical cells as typified by U.S. Pat. Nos. 3,990,915, 4,139,681, 4,143,213, 4,166,888, 4,091,191, 4,002,492 and 4,049,879.

SUMMARY OF THE INVENTION

According to the present invention, exhaust hydrocarbon emissions from an internal combustion engine being operated on gasoline containing a cyclopentadienyl manganese antiknock are reduced by providing new additive fluids and gasoline compositions which contain an exhaust emission reducing amount of a compound of the general formula:

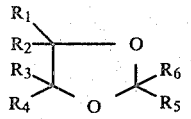

wherein $R_1$–$R_6$ are each independently selected from hydrogen or hydrocarbyl radicals.

DESCRIPTION OF THE PREFERRED EMBODIMENTS

The essence of the present invention resides in reducing the exhaust hydrocarbon emissions from internal combustion engines which burn a gasoline containing an organomanganese antiknock compound. This reduction in emissions can be effected by the addition to the gasoline of a compound of the general formula:

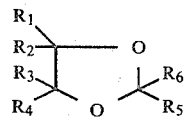

wherein $R_1$–$R_6$ are each independently selected from hydrogen or hydrocarbyl radicals. Thus, a preferred embodiment of the present invention is lead-free or substantially lead-free hydrocarbon fuel suitable for use in a spark ignited internal combustion engine which comprises a major amount of hydrocarbons boiling in the gasoline boiling range, an amount of an organomanganese compound, preferably a cyclopentadienyl manganese tricarbonyl, sufficient to increase its antiknock effectiveness, and an exhaust emission reducing amount of a compound having the general formula:

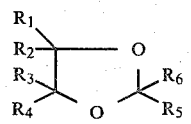

wherein $R_1$–$R_6$ are each independently selected from hydrogen or hydrocarbyl radicals.

Another embodiment of the present invention is a gasoline additive fluid composition comprising an organomanganese compound, preferably a cyclopentadienyl manganese tricarbonyl, and most preferably methylcyclopentadienyl manganese tricarbonyl, in an amount sufficient to improve the antiknock characteristics of the gasoline and compounds of the general formula:

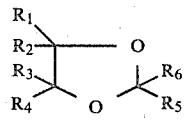

wherein $R_1$–$R_6$ are each independently selected from hydrogen or hydrocarbyl radicals in an amount sufficient to reduce hydrocarbon emissions from an internal combustion engine being operated on the gasoline.

Since the invention also embodies the operation of an internal combustion engine in a manner which results in reduced hydrocarbon exhaust emissions, a further embodiment of the present invention is a method of operating a spark ignited internal combustion engine using a gasoline containing an organomanganese, preferably a cyclopentadienyl manganese tricarbonyl, and most preferably methylcyclopentadienyl manganese tricarbonyl antiknock in a manner which results in the reduction of exhaust hydrocarbons emitted therefrom, said method comprising (a) supplying to the fuel induction system of said engine a gasoline containing an organomanganese antiknock and a gasoline soluble solution of compounds of the general formula:

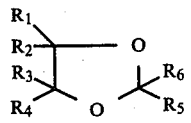

wherein $R_1$–$R_6$ are each independently selected from hydrogen or hydrocarbyl radicals, (b) mixing said gasoline with air, (c) inducting the mixture into the combustion chambers of said engine, (e) igniting said compressed mixture, (f) exhausting the resultant combustion products which have a reduced amount of unburned or partially oxidized hydrocarbons.

The base fuel in the composition of the invention comprises a mixture of liquid hydrocarbons boiling in the gasoline boiling range of from about 80° F. to about 430° F. Of course, these mixtures can contain individual constituents boiling above or below these figures. These hydrocarbon mixtures contain aromatic hydrocarbons, saturated hydrocarbons and olefinic hydrocarbons. The bulk of the hydrocarbon mixture is obtained by refining crude petroleum by either straight distillation or through the use of one of the many known refining processes, such as thermal cracking, catalytic cracking, catalytic hydroforming, catalytic reforming, and the like. Generally, the final gasoline is a blend of stocks obtained from several refinery processes. The final blend may also contain hydrocarbons made by other procedures such as alkylate made by the reaction of $C_4$ olefins and butanes using an acid catalyst such as sulfuric acid or hydrofluoric acid.

Preferred gasolines are those having a Research Octane Number of at least 85. A more preferred Research Octane Number is 90 or greater. It is also preferred to blend the gasoline such that it has a content of aromatic hydrocarbons ranging from 10 to about 60 volume percent, an olefinic hydrocarbon content ranging from 0 to about 30 volume percent, and a saturate hydrocarbon content ranging from about 40 to 80 volume percent, based on the whole gasoline.

In order to obtain fuels having properties required by modern automotive engines, a blending procedure is generally followed by selecting appropriate blending stocks and blending them in suitable proportions. The required octane level is most readily accomplished by employing aromatics (e.g. BTX, catalytic reformate or the like), alkylate (e.g. $C_{6-9}$ saturates made by reacting $C_4$ olefins with isobutane using a HF or $H_2SO_4$ catalyst), or blends of different types.

The balance of the whole fuel may be made up of other components such as other saturates, olefins, or the like. The olefins are generally formed by using such procedures as thermal cracking, catalytic cracking and polymerization. Dehydrogenation of paraffins to olefins can supplement the gaseous olefins occurring in the refinery to produce feed material for either polymerization or alkylation processes. The saturated gasoline components comprise paraffins and naththenates. These saturates are obtained from (1) virgin gasoline by distillation (straight run gasoline), (2) alkylation processes (alkylates) and (3) isomerization procedures (conversion of normal paraffins to branched chain paraffins of greater octane quality). Saturated gasoline components also occur in so-called natural gasolines. In addition to the foregoing, thermally carcked stocks, catalytically cracked stocks and catalytic reformates contain saturated components.

The classification of gasoline components into aromatics, olefins and saturates is well recognized in the art. Procedures for analyzing gasolines and gasoline components for hydrocarbon composition have long been known and used. Commonly used today is the FIA analytical method involving fluorescent indicator adsorption techniques. These are based on selective adsorption of gasoline components on an activated silica gel column; the components being concentrated by hydrocarbon type in different parts of the column. Special fluorescent dyes are added to the test sample and are also selectively separated with the sample fractions to make the boundaries of the aromatics, olefins and saturates clearly visible under ultraviolet light. Further details concerning this method can be found in "1969 Book of ASTM Standards", January 1969 Edition, under ASTM Test Designation D 1319-66T.

The motor gasolines used in formulating the improved fuels of this invention generally have initial boiling points ranging from about 80° F. to about 105° F. and final boiling points ranging from about 380° F. to about 430° F. as measured by the standard ASTM distillation procedure (ASTM D-86). Intermediate gasoline fractions boil away at temperatures within these extremes.

From the standpoint of minimizing atmospheric pollution to the greatest extent posible, it is best to keep the olefin content of the fuel as low as can be economically achieved as olefins reportedly gave rise to smog-forming emissions, especially from improperly adjusted vehicular engines. Accordingly, in the preferred base stocks of this invention the olefin content will not exceed about 10 volume percent and the most particularly preferred fuels will not contain more than about 5 percent olefins. Table 1 illustrates the hydrocarbon-type makeup of a number of particularly preferred fuels which can be used in this invention.

TABLE 1

Hydrocarbon Blends of Particularly Preferred Base Fuels

| | Volume Percentage | | |
|---|---|---|---|
| Fuel | Aromatics | Olefins | Saturates |
| A | 35.0 | 2.0 | 63.0 |
| B | 40.0 | 1.5 | 58.5 |
| C | 20.0 | 2.5 | 77.5 |
| D | 33.5 | 1.0 | 65.5 |
| E | 36.5 | 2.5 | 61.0 |
| F | 43.5 | 1.5 | 55.0 |
| G | 49.5 | 2.5 | 48.0 |

It is also desirable to utilize base fuels having a low sulfur content as the oxides of sulfur tend to contribute an irritating and choking character to smog and other forms of atmospheric pollution. Therefore, to the extent it is economically feasible, the fuel will contain not more than about 0.1 weight percent of sulfur in the form of conventional sulfur-containing impurities. Fuels in which the sulfur content is no more than about 0.02 weight percent are especially preferred for use in this invention.

Normally the gasoline to which this invention is applied is lead-free or substantially lead-free. The gasoline may contain antiknock quantities of other agents such as cyclopentadienyl nickel nitrosyl, N-methyl aniline, and the like. Antiknock promoters such as 2,4 pentanedione may be included. The gasoline may further contain blending agents or supplements such as methanol, isopropanol, t-butanol and the like. Antioxidants such as 2,6-di-tert-butylphenol, 2,6-di-tert-butyl-p-cresol, phenylenediamines such as N,N'-di-sec-butyl-p-phenylenediamine, N-isopropylphenylenediamine, and the like, may be present. Likewise, the gasoline can contain dyes, metal deactivators, or other types of additives recognized to serve some useful purpose in improving the gasoline quality.

Cyclopentadienyl manganese tricarbonyls are known antiknocks and their preparation and use are described in U.S. Pat. Nos. 2,818,417, 2,839,552, and 3,127,351. An important antiknock of this type is methylcyclopentadienyl manganese tricarbonyl. The amount of the cyclopentadienyl manganese tricarbonyl added to the gasoline should be an amount adequate to increase its antiknock effectiveness. This has been found to be in the range of from about 0.005 to about 10 grams per gallon of manganese as a cyclopentadienyl manganese tricarbonyl. A preferred range is from about 0.05 to 6.0 grams of manganese per gallon as a cyclopentadienyl manganese tricarbonyl. A more preferred range is from about 0.05 to about 0.25 grams of manganese per gallon and a most preferred range is from about 0.05 to about 0.125 grams of manganese per gallon as methylcyclopentadienyl manganese tricarbonyl.

The hydrocarbon exhaust emission reducing additives of the present invention are known compounds whose preparation is known in the art. These compounds are organic ethers which have the general formula:

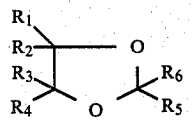

wherein $R_1$–$R_6$ are each independently selected from hydrogen or hydrocarbyl radicals. They are best considered as cyclic acetals or ketals of polyhydric alcohols and are commonly referred to as 1,3-dioxolanes. Substantially all direct synthesis of 1,3-dioxolane and its derivatives proceed by condensation of a 1,2-glycol with a carbonyl compound, and for optimum results an acid catalyst is desirable. The carbonyl component may be either an aldehyde or a ketone, and the 1,2-glycol may be a 1,2-glycol as such or a related derivative such as an $\alpha$-hydroxy acid. The most preferred exhaust emission reducing additive of the present invention, 1,3-dioxolane, is prepared by reacting formaldehyde with ethylene glycol. These and other methods of preparation are more fully described in Elderfield, R. C. *Heterocyclic Compounds.* N.Y., Wiley, Vol. 5, 1957, pp. 1–15. In a preferred embodiment of this invention $R_1$–$R_6$ are each independently selected from hydrogen and hydrocarbyl radicals. Preferably, the hydrocarbyl radicals are the lower alkyls and alkenyls of up to about 4 carbon atoms. The most preferred hydrocarbyls are methyl and ethyl.

Examples of suitable alkyl groups are methyl, ethyl, n-propyl, isopropyl, n-butyl, isobutyl, sec-butyl, tert-butyl, and the various positional isomers thereof.

Examples of alkenyl groups are ethenyl, propenyl, 2-propenyl, isopropenyl, 1-butenyl, 2-butenyl, 3-butenyl, and the corresponding branched-chain isomers thereof as for example, 1-isobutenyl, 2-isobutenyl and 2-sec-isobutenyl.

In the most preferred embodiment of the present invention $R_1$–$R_6$ are each hydrogen.

In order to be most advantageously employed as emission reducing agents the above compounds should be readily woluble, either directly or indirectly in the gasoline.

Further, these compounds should be volatile enough to volatilize under the conditions of temperature and pressure existent in the engine. The aforedescribed compounds should also not adversely affect or react in the gasoline.

The novel fuel compositions of the present invention are prepared simply by adding the cyclopentadienyl manganese antiknock compound and the exhaust hydrocarbon emission reducing additives of the present invention to the base fuel with sufficient agitation to give a uniform blend of motor fuel. The amount of emission reducing compound described above sufficient to reduce emissions is at least to some extent dependent upon the amount of manganese present in the gasoline. Generally, the greater the concentration of manganese, the greater the amount of additive compound needed to reduce exhaust emissions.

Broadly, the additive can be employed in a range of from about 0.01 gram of additive to about 30.0 grams of additive per gallon of fuel. It is to be understood that concentrations somewhat outside of this range can be used if desired. A particularly preferred concentration of exhaust emission reducing additive is from about 0.25 to about 10.0 grams of additive per gallon of fuel. An even more preferred concentration of additive is from about 0.5 gram to about 1.0 gram of additive per gallon of fuel. There is no real upper limit on the amount of additive that can be added to the motor fuel compositions of the present invention other than perhaps a maximum limitation directed by economic considerations. In general, however, one uses an additive quantity having adequate exhaust emission reducing properties.

Having described the invention in general terms, the following examples are offered to specifically illustrate the invention. It is to be understood they are illustrations only and that the invention shall not be limited except as limited by the appended claims.

EXAMPLE 1

This example illustrates the exhaust emission reducing properties of the additive of this invention.

A dynamometer test was conducted to demonstrate the useful exhaust emission reducing properties of the present exhaust hydrocarbon emission reducing agent. In this test, a 4-cylinder engine having an 8.3:1 compression ratio and a 151 cubic inch (2.5 liter) displacement equipped with a production 2-barrel carburetor, EGR and an EFE intake manifold was operated on an unleaded gasoline containing 0.125 gram of manganese as methylcyclopentadienyl manganese tricarbonyl. The engine was idled for 45 seconds and then run at 50% wide open throttle for 145 seconds under the following conditions.

TABLE 2

| | Idle | Cruise (50 MPH Road-Load) |
|---|---|---|
| Time | 45 sec. | 135 sec. |
| Speed | 1000 RPM | 2250 RPM |
| Load | None | 35 ft-lb |
| Man. Vac. | 20 in. Hg | 13 in. Hg |
| A/F Ratio | Stoichiometric | 16.0 |

The above cycle was continuously repeated until the hydrocarbon emissions had stabilized. This usually required about 140–145 hours of operation. The hydrocarbon content of the exhaust gas was determined using a Beckman 400 Flame Isomerization Detector. The procedure was first carried out using a fuel without the emission reducing additive to obtain a baseline exhaust emission increase and then repeated on the same fuel containing the emission reducing additive. This was followed by another test on the fuel, again without the emission additive, to reconfirm the baseline. After about each 24 hours of test time, hydrocarbon emission measurements were taken at 50% wide open throttle after which the engine was returned to the cycling schedule. At the end of approximately 140 hours of testing, hydrocarbon emission measurements were taken at 50% wide open throttle after which the engine was returned to the cycling schedule for a 1–2 hour period and then shut down. Using this procedure, the percent reduction in exhaust hydrocarbon emission increase was obtained using the emission reducing additive of this invention.

The base fuel employed in these test contained 0.125 gram of manganese per gallon of fuel as methylcyclopentadienyl manganese tricarbonyl and consisted of 22.5% aromatics, 8.0% olefins and 69.5% aliphatic hydrocarbons. The fuel had an ASTM distillation, I.B.P. of 89° F., an E.P. of 394° F.; a Research Octane No. of 92.77 and a Motor Octane No. of 83.43.

The concentration of exhaust emission reducing agent tested was 5.0 grams of additive per gallon of fuel. The test fuel was prepared by simply adding a sufficient amount of 1,3-dioxolane (98% pure) obtained commercially from the Aldrich Chemical Co., Inc. P.O. Box 355, Milwaukee, Wis. 53201 to the base fuel, described above, containing 0.125 gram of manganese as methylcyclopentadienyl manganese tricarbonyl to provide a fuel composition having 5.0 grams of additive per gallon of fuel.

The following results were obtained in the aforedescribed test with and without the indicated amount of hydrocarbon exhaust emission reducing additive, aforedescribed.

TABLE 3

| Additive | Hydrocarbon, p.p.m.[1] | Reduction of Emission Increase % |
|---|---|---|
| None | 200 | |
| 1,3 dioxolane | 145 | 32% |

[1]End of test minus start of test results

As these results show, the emission reducing additives of the present invention effectively reduce exhaust emission increases in gasoline containing cyclopentadienyl manganese antiknocks.

It is convenient to utilize additive fluid mixtures composed of cyclopentadienyl manganese tricarbonyl antiknock agents and exhaust emission reducing agents described above. These additive fluid mixtures can be added to low-lead or unleaded gasoline. In other words, part of the present invention are antiknock-hydrocarbon exhaust emission reducing additive fluids which comprise cyclopentadienyl manganese tricarbonyl antiknock agents and the exhaust emission reducing agents of the type described hereinabove.

Use of such antiknock-exhaust emission reducing fluids in addition to resulting in great convenience in storage, handling, transportation, blending with fuels and so forth, also are potent concentrations which serve the multi-purpose functions as being useful as antiknocks, and hydrocarbon exhaust emission reducers.

In these fluid compositions the weight ratio of exhaust emission reducing agent to manganese can vary from about 200 parts hydrocarbon exhaust emission reducing agent to about 1 part by weight manganese and from about 1 part by weight hydrocarbon exhaust emission reducing agent to about 100 parts by weight manganese. A preferred weight ratio is from about 12 parts by weight exhaust emission reducing agent to about 1 part by weight manganese and from about 36 parts exhaust emission reducing agent to about 1 part manganese. Especially preferred additive concentrates comprise equal parts of exhaust emission reducing agents and manganese. A preferred cyclopentadienyl manganese antiknock concentrate component is methylcyclopentadienyl manganese tricarbonyl.

The amount of additive concentrate added to a lead-free or substantially lead-free gasoline is an amount sufficient to provide from 0.01 to about 30.0 grams of exhaust emission reducing agent per gallon of gasoline and from about 0.005 to about 10 grams of manganese, preferably as methylcyclopentadienyl manganese tricarbonyl, per gallon of gasoline.

The concentrates of this invention are readily prepared by merely blending the organomanganese antiknock compound and exhaust emission reducing additive together until a homogeneous solution having the desired weight ratio of exhaust emission reducing agent to manganese is obtained. The concentrates may optionally contain other additives normally used with gasoline such as dyes, stabilizers, anti-oxidants, anti-rust agents, detergents, solvents, etc. The concentrate serves to facilitate the addition of a number of additives to the fuel in only one step.

The following examples illustrate the preparation of some typical concentrations.

EXAMPLE 2

To a blending vessel is added 200 parts of the emission reducing compound identified and described in Example 1 above and 1 part manganese as methylcyclopentadienyl manganese tricarbonyl. The mixture is stirred until homogeneous, forming an additive concentrate useful for improving the exhaust emission reducing properties of a lead-free or substantially lead-free gasoline.

EXAMPLE 3

To a blending vessel is added 12 parts of emission reducing compound identified and described in Example 1 above and 1 part manganese as methylcyclopentadienyl manganese tricarbonyl. The mixture is stirred until homogeneous, forming an additive concentrate useful for improving the exhaust emission reducing properties of a lead-free or substantially lead-free gasoline.

Although the compounds of the present invention have the most utility when added to gasoline, they can also be used in conjunction with other liquid petroleum distillate fuels such as kerosene, diesel fuel, jet engine fuel and the like.

Claims to the invention follow:

I claim:

1. As a composition of matter, a lead-free or substantially lead-free hydrocarbon fuel composition for use in a spark ignited internal combustion engine to reduce hydrocarbon emissions comprising (i) a major amount of hydrocarbons boiling in the gasoline boiling range, (ii) an antiknock amount of a cyclopentadienyl manganese tricarbonyl antiknock compound, and (iii) an exhaust emission reducing amount of a compound having the general formula:

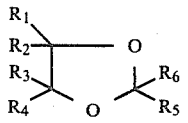

wherein $R_1$–$R_6$ are each independently selected from hydrogen or hydrocarbyl radicals.

2. The composition of claim 1 where said cyclopentadienyl group is a hydrocarbon group containing from 5 to about 17 carbon atoms.

3. The composition of claim 2 wherein said cyclopentadienyl group is methylcyclopentadienyl.

4. The composition of claim 3 wherein said hydrocarbyl radical is an alkyl radical having from 1 to about 4 carbon atoms.

5. The composition of claim 4 wherein said alkyl radical is methyl.

6. The composition of claim 4 wherein said alkyl radical is ethyl.

7. The composition of claim 3 wherein said hydrocarbyl radical is an alkenyl radical having from 2 to about 4 carbon atoms.

8. The composition of claim 3 wherein $R_1$–$R_6$ are each hydrogen.

9. An additive fluid for gasoline to reduce hydrocarbon emissions comprising (i) a cyclopentadienyl manganese tricarbonyl antiknock compound, and (ii) a compound having the general formula:

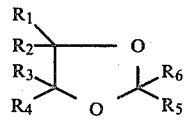

wherein $R_1$–$R_6$ are each independently selected from hydrogen or hydrocarbyl radicals.

10. The additive fluid or claim 9 wherein said fluid contains an antiknock amount of said cyclopentadienyl manganese tricarbonyl antiknock compound.

11. The additive fluid of claim 9 wherein said fluid contains an amount sufficient to reduce exhaust hydrocarbon emissions of a compound having the general formula:

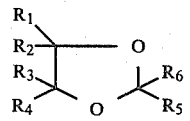

wherein $R_1$–$R_6$ are each independently selected from hydrogen or hydrocarbyl radicals.

12. The additive fluid of claim 9 wherein said cyclopentadienyl group is a hydrocarbon group containing from 5 to about 17 carbon atoms.

13. The additive fluid of claim 12 wherein said cyclopentadienyl group is methylcyclopentadienyl.

14. The additive fluid of claim 13 wherein said hydrocarbyl radical is an alkyl radical having from 1 to about 4 carbon atoms.

15. The additive fluid of claim 14 wherein said alkyl radical is methyl.

16. The additive fluid of claim 14 wherein said alkyl radical is ethyl.

17. The additive fluid of claim 13 wherein said hydrocarbyl group is an alkenyl group having from 2 to about 4 carbon atoms.

18. The additive fluid of claim 13 wherein $R_1$–$R_6$ are each hydrogen.

* * * * *